US005560084A

United States Patent [19]

Baker

[11] Patent Number: 5,560,084

[45] Date of Patent: Oct. 1, 1996

[54] SLIDER

[75] Inventor: Neil M. Baker, Barnwood, United Kingdom

[73] Assignee: Securistyle Limited, Cheltenham, United Kingdom

[21] Appl. No.: 279,233

[22] Filed: Jul. 22, 1994

[30] Foreign Application Priority Data

Aug. 20, 1993 [GB] United Kingdom ..... 9317350

[51] Int. Cl.[6] ..... E05D 13/00

[52] U.S. Cl. ..... 16/193; 16/368

[58] Field of Search ..... 16/327, 328, 348, 16/193, 199, 368, 369, 370; 49/428, 404, 176

[56] References Cited

U.S. PATENT DOCUMENTS

| | | | |
|---|---|---|---|
| 3,052,931 | 9/1962 | Ewing | 49/176 |
| 3,797,169 | 3/1974 | Armstrong | 49/248 |
| 5,036,621 | 8/1991 | Iwasaki | 49/428 |

FOREIGN PATENT DOCUMENTS

| | | |
|---|---|---|
| 04404348A1 | 12/1990 | European Pat. Off. . |
| 2047309 | 11/1980 | United Kingdom . |
| WO87/05963 | 3/1987 | WIPO . |

*Primary Examiner*—Chuck Y. Mah
*Attorney, Agent, or Firm*—Greenlee, Winner and Sullivan

[57] ABSTRACT

A friction slider 1 for a friction stay, comprising a body 3, preferably formed of metal, for attachment to struts of a stay, the metal body 3 being shaped to fit and be retained within a channel of the stay, a plastics skin 5 overlaying the metal body 3 to separate the metal body 3 from the channel of a stay, during use, and adjustable means 7 cooperating with the metal body 3 for driving the plastics skin 5 away from the metal body 3 to adjust the friction between the slider 1 and the channel of the stay, during use.

7 Claims, 1 Drawing Sheet

SLIDER

This invention relates to friction sliders for friction supporting stays.

Friction supporting stays are well known which comprise a support channel for attachment to a window frame or the like, a vent arm for attachment to a window and a plurality of struts connecting the vent arm with the support channel. Some of the struts are mounted on a friction slider which is free to move along the support channel to open or close the friction stay and hence the window or other vent.

A known friction slider for inclusion in a friction supporting stay as described above comprises a plastics body or block shaped to be received in the support channel of a friction stay. Inwardly extending walls of the channel ensure that the slider is held within the channel but is free to move therealong. The body includes a recess on its underside for receiving a friction pad which contacts the inside surface of the base of the channel. A grub screw threadedly engages the body of the slider and extends therethrough to cooperate with the friction pad. By turning the grub screw, the friction pad is urged away from the body of the slider and into contact with the support channel, thereby increasing the friction between the slider and the support channel. The friction between the slider and the support channel can be adjusted to a level which is appropriate for the particular weight of the window or vent being supported via the stay.

Although friction sliders as described above function very well, in some market places customers are concerned that the use of a plastics slider is not sufficiently strong to support a heavy window or vent. Hence, the present invention has been devised to overcome this problem and to provide an improved friction slider for a friction supporting stay.

According to the present invention, there is provided a friction slider for a friction supporting stay, comprising a body for attachment to struts of a stay, the body being shaped to fit and be retained within a channel of the stay, a plastics skin overlaying the body to separate the body from the channel of a stay, during use, and adjustable means cooperating with the body for driving the plastics skin away from the body to adjust the friction between the slider and the channel of the stay, during use.

By forming the body from a material having a perceived high strength, such as metal, the friction slider will appear more satisfactory to some users. Furthermore, if a thread for a grub screw is tapped into the metal body, the strength of the thread will be stronger than a similar thread formed in a weaker plastics body of a prior art slider. Hence, a friction slider according to the present invention will not only have an increase in perceived strength over known prior art sliders, but may have an increase in actual strength also.

Of course, the body may be manufactured from any material having appropriate strength, including a high strength plastics material. In such a case, the material does not need to be suitable for making sliding contact with a support channel of a stay, during use, because the skin prevents contact between the body and the support channel.

Preferably the body includes a recess into which a bulge of the plastics skin extends. As a result of the bulge, the plastics skin will not wear out prematurely as a result of the friction between the slider and the support channel.

The plastics skin is preferably manufactured by extrusion and cut to length. The body may then simply be slid into the plastics skin during assembly. Alternatively, of course, the plastics skin may be injection moulded or the body may be forced into the skin with a snap fit.

Although the plastics skin is preferably formed in one piece, it could be assembled from two or more pieces, if desired.

The body preferably has a Ω-shaped cross-section in its longitudinal direction. If such a shape is used, the feet of the Ω fit underneath the inwardly extending walls or flanges of the support channel to retain the friction slider in the support channel.

The adjustable means may be a grub screw threadedly engaging the body and bearing against the inside of the plastics skin. More preferably, the grub screw bears against the bulge of the plastics skin. Alternatively, some form of camming device could be used as the adjustable means.

The plastics skin may include a blind bore for receiving the end of the grub screw. By allowing the grub screw to enagage the skin in this way, separation of the body and the plastics skin during assembly and/or use can be prevented.

Although the body is preferably made of steel, other suitable materials can, of course, also be used.

Likewise, although the plastics skin is preferably manufactured from acetal, nylon or polypropylene, other suitable plastics materials may also be used.

The present invention further provides a friction supporting stay comprising a friction slider including a body, a plastics skin and an adjustable means as herein described.

A specific embodiment of the present invention is now described, by way of example only, with reference to the accompanying drawings, in which.

Figure 1:
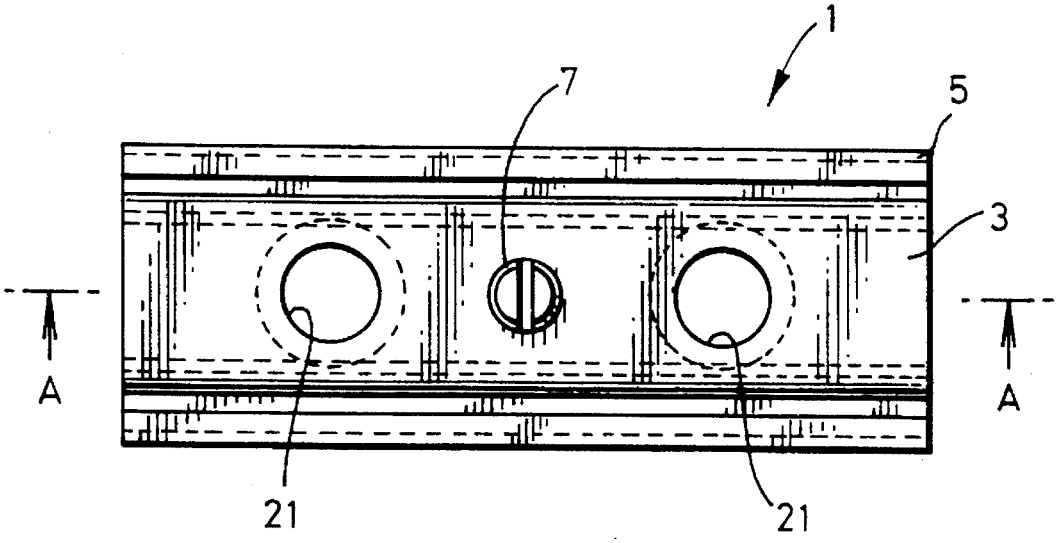
FIG. 1 is a plan view of a friction slider according to the present invention.
Figure 2:
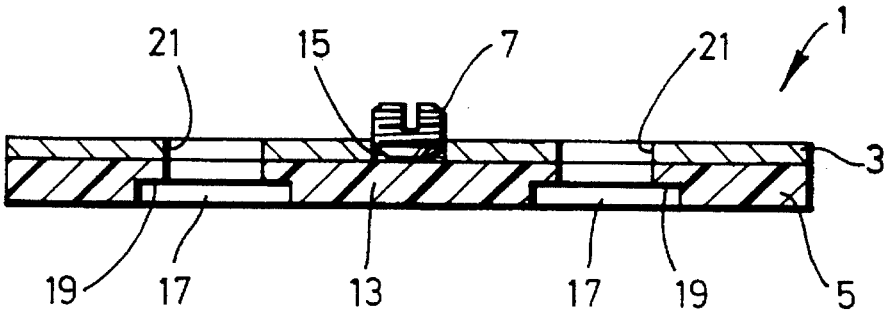
FIG. 2 is a sectional side view along the line A—A of FIG. 1.
Figure 3:
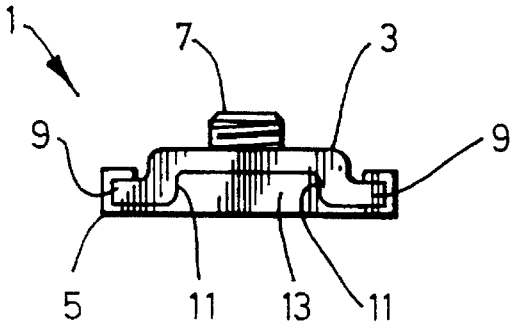
FIG. 3 is an end view of the friction slider of FIGS. 1 and 2.

With reference to the drawings, a friction slider 1 according to the present invention comprises a metal body 3, a plastics skin 5 and a grub screw 7 threadedly engaging the metal body 3.

The metal body 3 has a generally Ω-shaped cross-section in its longitudinal direction. The feet of the Ω being shaped to fit beneath inwardly extending flanges of a support channel (not shown) of a friction stay. The metal body 3, which is ideally manufactured from steel, can be easily formed by simply pressing a flat strip of steel.

The plastics skin 5 separates the metal body 3 from the support channel of a friction stay, in use. This is helpful because the support channel is usually manufactured from metal and if the metal body 3 were to come into direct contact with the metal support channel, undue wear or binding would result and possibly even corrosion (if the components became damp). Thus, the plastics skin 5 encases the feet 9 of the metal body 3 such that the plastics skin 5 is the only part of the friction slider 1 which contacts a support channel, during use.

The Ω-shaped metal body 3 includes a longitudinal recess 11 which is filled by a bulge 13 of the plastics skin 5. This is advantageous because it is against this region of the skin 5 (i.e. including the bulge 13) that the grub screw 7 bears to urge the skin 5 into contact with the bottom of a support channel, during use, to provide some friction between the slider and the support channel. The flexing of the skin 5 by means of the grub screw 7 also causes the side and/or edge regions of the skin 5 to separate slightly from the metal body 3 to provide additional friction between the slider 1 and the support channel of the stay, during use.

The amount of friction between the slider 1 and a support channel is dictated by the position of the grub screw 7. In this regard, the grub screw 7 may be turned using a screw driver to define the position of the plastics skin 5 relative to the metal body 3. More specifically, the grub screw 7 extends through a threaded bore 15 in the metal body 3 and contacts the bulge 13 of the plastics skin 5.

The bulge 13 of the plastics skin 5 includes two apertures 17 each including a shoulder region 19 for receiving a rivet (not shown) for attaching struts of a supporting stay to the slider 1. The metal body 3 also includes a pair of apertures 21 through which the rivets (not shown) pass. Thus, the metal body 3 and the plastics skin 5 are held together during use by means of the rivets (not shown) engaging the struts of the supporting stay.

It will of course be understood that the present invention has been described above purely by way of example, and that modifications of detail can be made within the scope of the invention.

I claim:

1. A friction slider comprising a metalic body adapted to fit and be retained within a channel of a stay during use, a plastics skin overlaying the body adapted to separate the body from the channel of a stay during use, and adjustable means cooperating with the body for driving the plastics skin away from the body whereby the friction between the slider and the channel of the stay is adjustable during use.

2. The friction slider of claim 1, wherein the body comprises a recess for receiving a bulge of the plastics skin.

3. The friction slider of claim 1, wherein the plastics skin is produced by extrusion and cut to length, and the body is slid into the plastics skin during assembly.

4. The friction slider of claim 1, wherein the body has a Ω-shaped cross-section in its longitudinal direction.

5. The friction slider of claim 1, wherein the adjustable means is a grub screw threadedly engaging the body and bearing against the inside of the plastics skin.

6. The friction slider of claim 1, wherein the metallic body is steel.

7. The friction slider of claim 1, wherein the plastics skin is formed of a plastic material selected from the group consisting of acetal, nylon and polypropylene.

* * * * *